US011185197B2

(12) United States Patent
Mendez

(10) Patent No.: US 11,185,197 B2
(45) Date of Patent: Nov. 30, 2021

(54) WINDOW CLEANING TOOL

(71) Applicant: Tri-Edge Industries, LLC, Lake Worth, FL (US)

(72) Inventor: Jay Mendez, Greenacres, FL (US)

(73) Assignee: TRI-EDGE INDUSTRIES, LLC, West Palm Beach, FL (US)

( * ) Notice: Subject to any disclaimer, the term of this patent is extended or adjusted under 35 U.S.C. 154(b) by 168 days.

(21) Appl. No.: 16/573,494

(22) Filed: Sep. 17, 2019

(65) Prior Publication Data

US 2021/0076889 A1 Mar. 18, 2021

(51) Int. Cl.
*A47L 1/15* (2006.01)
*A47L 13/18* (2006.01)

(52) U.S. Cl.
CPC ..... *A47L 1/15* (2013.01); *A47L 13/18* (2013.01)

(58) Field of Classification Search
CPC . A47L 1/15; A47L 13/10; A47L 13/16; A47L 13/29; A47L 13/44; A47L 23/04; A47L 13/18; A47L 11/06; A47L 1/06; B60S 3/045
USPC ..... 15/220.1, 227, 209.1, 210.1
See application file for complete search history.

(56) References Cited

U.S. PATENT DOCUMENTS

2004/0200023 A1* 10/2004 Post ..... A47L 13/20 15/220.1
2008/0034521 A1* 2/2008 Probasco ..... A47L 1/15 15/143.1
2009/0113647 A1* 5/2009 Barstad ..... B24D 15/023 15/105

* cited by examiner

*Primary Examiner* — Laura C Guidotti
*Assistant Examiner* — Thomas Raymond Rodgers
(74) *Attorney, Agent, or Firm* — Malloy & Malloy, P.L.; Robert M. Downey

(57) ABSTRACT

A window cleaning tool for removing dirt, dust, residue and other debris from the surface of a window includes a rigid plate member having a flat top surface, a flat bottom surface, a peripheral side edge including a back edge and left and right side edges converging towards one another and meeting at a nose of the plate member. A strap passes through elongate slot openings in the plate member to allow the plate member to be secured to a user's hand with the back of the user's hand engaged against the top surface of the plate member. Hook components of a hook and loop fastener on the bottom of the plate member allow for releasable attachment of a non-scratch scouring pad thereto. The scouring pad is generally configured to match the shape of the plate member as defined by the outer peripheral edge.

4 Claims, 6 Drawing Sheets

WINDOW CLEANING TOOL

BACKGROUND OF THE INVENTION

Field of the Invention

The present invention is directed to a window cleaning tool, and more particularly, to a tool for cleaning a surface of a window to remove dirt, dust, residue and other debris, and including a rigid flat plate member adapted for releasable attachment of a non-scratch scouring pad, and wherein the tool is adapted to be secured to a user's hand with an adjustable strap.

Discussion of the Related Art

Prior to the application of a film substrate to a glass surface, such as a window tinting film, it is necessary to remove all dust, dirt, debris and other residue from the glass surface so that the applied film can properly adhere to the glass surface with no bumps, scratches or separation. Of particular significance to the invention is the application of window tinting film to automobile windows, and particularly the rear window of an automobile. In attempting to clean the interior window surfaces, and particularly the rear window, it is sometimes difficult to reach all areas of the window. In particular, it is difficult to reach the corners of a rear window of an automobile to fully clean the glass surface. Presently, most cleaning pads are rectangular in shape and do not allow for easy reach and accessibility to the corners of a rear automobile window. Moreover, when trying to reach into the corners, the user often will jam their fingers into the window frame or other sharp structures surrounding the rear automobile window.

Accordingly, there remains a need in the window tinting industry for a glass cleaning tool that is particularly adapted for cleaning the interior surfaces of automobile windows, and particularly a rear window of an automobile in preparation for application of a window tinting film thereto.

SUMMARY OF THE INVENTION

The present invention is directed to a window cleaning tool for removing dirt, dust, residue and other debris from the surface of a window. The window cleaning tool includes a rigid plate member having a flat top surface, a flat bottom surface, a peripheral side edge including a back edge and left and right side edges converging towards one another and meeting at a nose of the plate member. A strap passes through elongate slot openings in the plate member to allow the plate member to be secured to a user's hand with the back of the user's hand engaged against the top surface of the plate member. Hook components of a hook and loop fastener on the bottom of the plate member allow for releasable attachment of a non-scratch scouring pad thereto. The scouring pad is generally configured to match the shape of the plate member as defined by the outer peripheral edge.

Objects and Advantages of the Invention

Considering the forgoing, it is a primary object of the present invention to provide a window cleaning tool that is particularly adapted for cleaning the inside surface of a rear window of an automobile to remove dust, dirt, debris and other residue prior to application of a film substrate thereto, such as a window tinting film.

It is a further object of the present invention to provide a window cleaning tool that is structured for releasable attachment of a non-scratch cleaning pad thereto for cleaning the inside surface of a rear window of an automobile, and wherein the cleaning tool is particularly adapted for reaching corners of the window.

It is still a further object of the present invention to provide a window cleaning tool for cleaning the inside surface of a rear window of an automobile, and wherein the window cleaning tool is structured to prevent injury to the user's fingers by protecting the fingers from hitting the sharp edges around the rear window of an automobile.

It is still a further object of the present invention to provide a window cleaning tool for releasable attachment of a non-scratch cleaning pad thereto, and wherein the window cleaning tool is particularly adapted for removing dust, dirt, debris and other residue from the glass surface of a rear window of an automobile prior to application of a film substrate thereto, such as a window tinting film, wherein the window cleaning tool is specifically structured for applying even pressure of the non-scratch cleaning pad against the window surface while moving the non-scratch cleaning pad in a reciprocating motion to clean the window surface.

These and other objects and advantages of the present invention are more readily apparent with reference to the following detailed description and accompanying drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
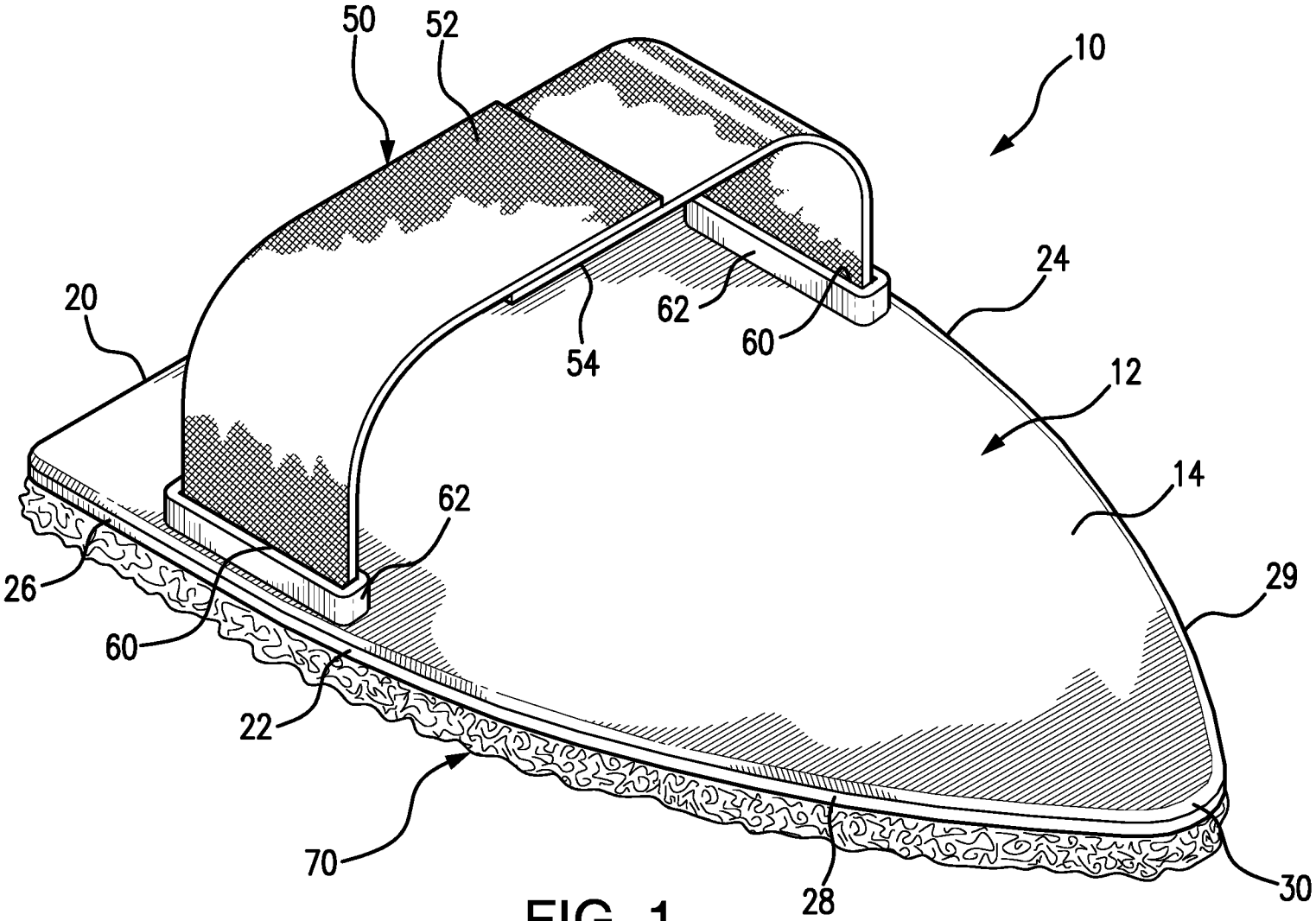
FIG. 1 is a top perspective view of the window cleaning tool of the present invention.
Figure 2:
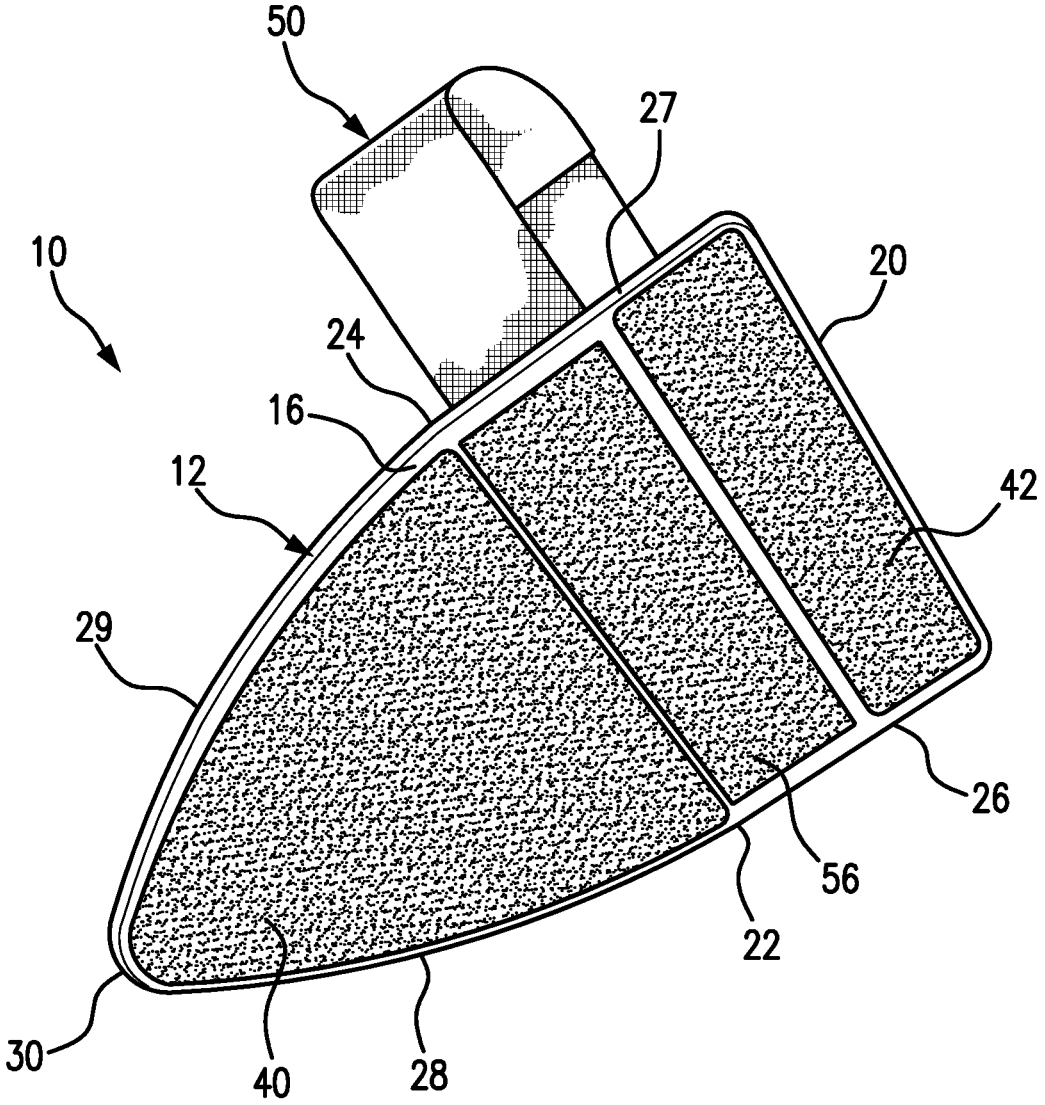
FIG. 2 is a rear perspective view of the window cleaning tool.
Figure 3:
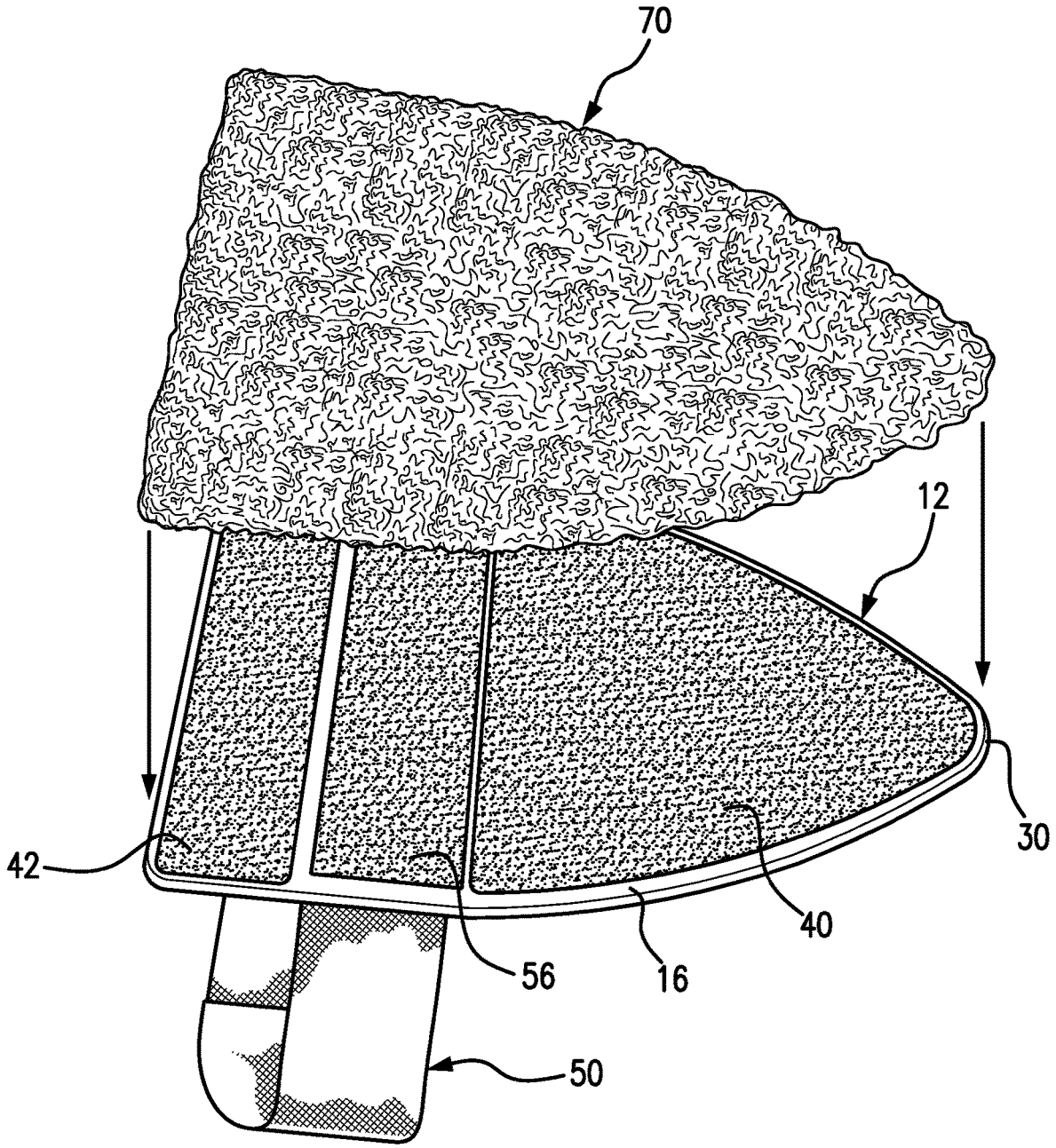
FIG. 3 is a bottom perspective view of the window cleaning tool shown illustrating attachment of a non-scratch scouring pad to a bottom of the window cleaning tool.

Referring to the several views of the drawings, and initially FIGS. 1 and 2, the window cleaning tool of the present invention is shown and is generally indicated as 10. The window cleaning tool 10 includes a rigid plate member 12 having a top surface 14, a flat bottom surface 16, and a peripheral edge defining an overall shape of the plate member. The peripheral edge includes a back edge 20, a right edge 22 and a left edge 24. The right edge 22 includes a rear portion 26 and the left side edge 24 includes a rear portion 27. The rear portions of the left and right side edges extend generally parallel to one another and perpendicular to the back edge 20. The rear portions of the left and right side edges transition into forward converging portions 28, 29, respectively. The forward converging portions 28, 29 gradually converge towards one another starting at the rear portions 26, 27 and then more abruptly converge, eventually meeting at a nose 30 of the plate member 12.

Figure 4:
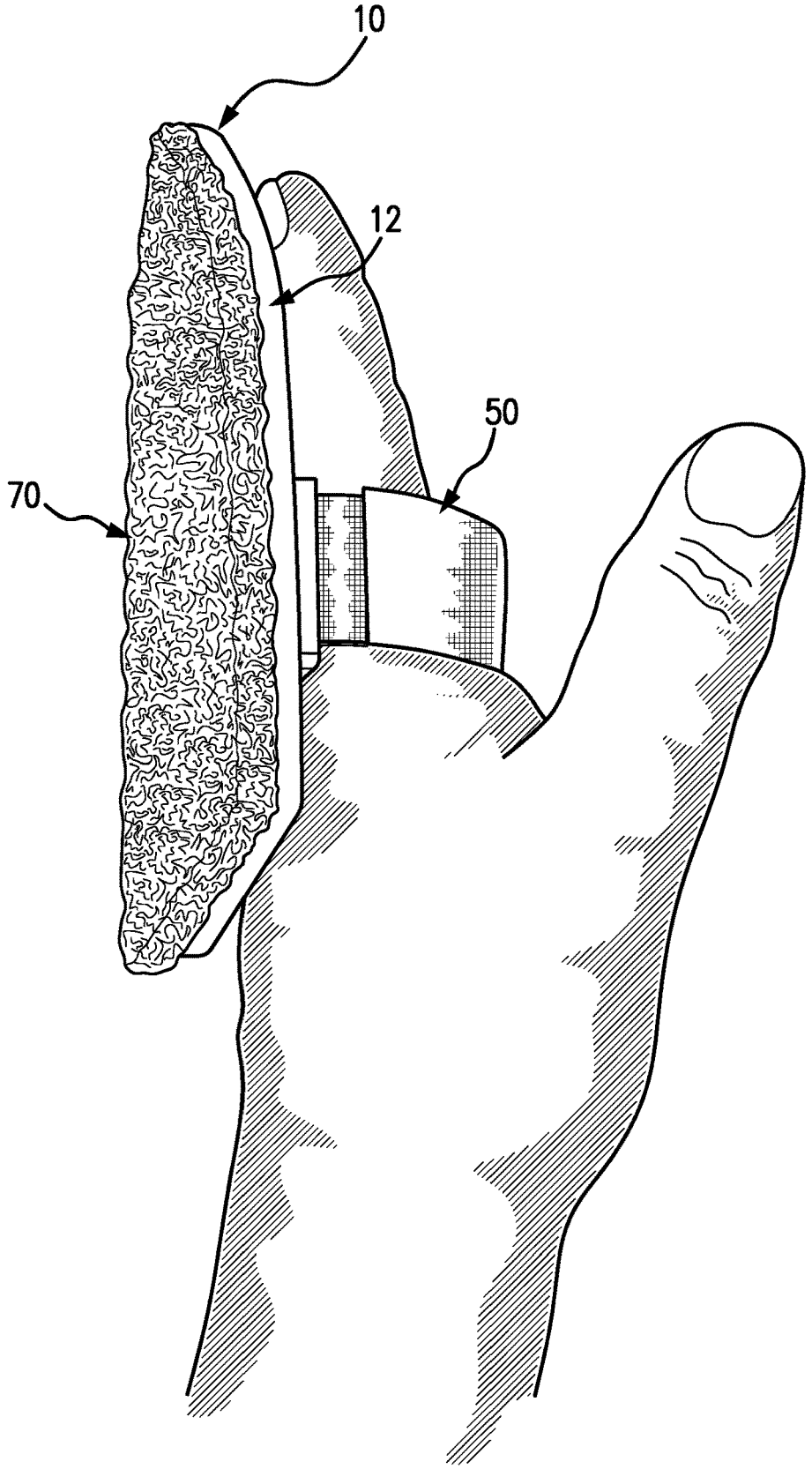
FIG. 4 is a perspective view showing the window cleaning tool secured to the hand of a user.
Figure 5:
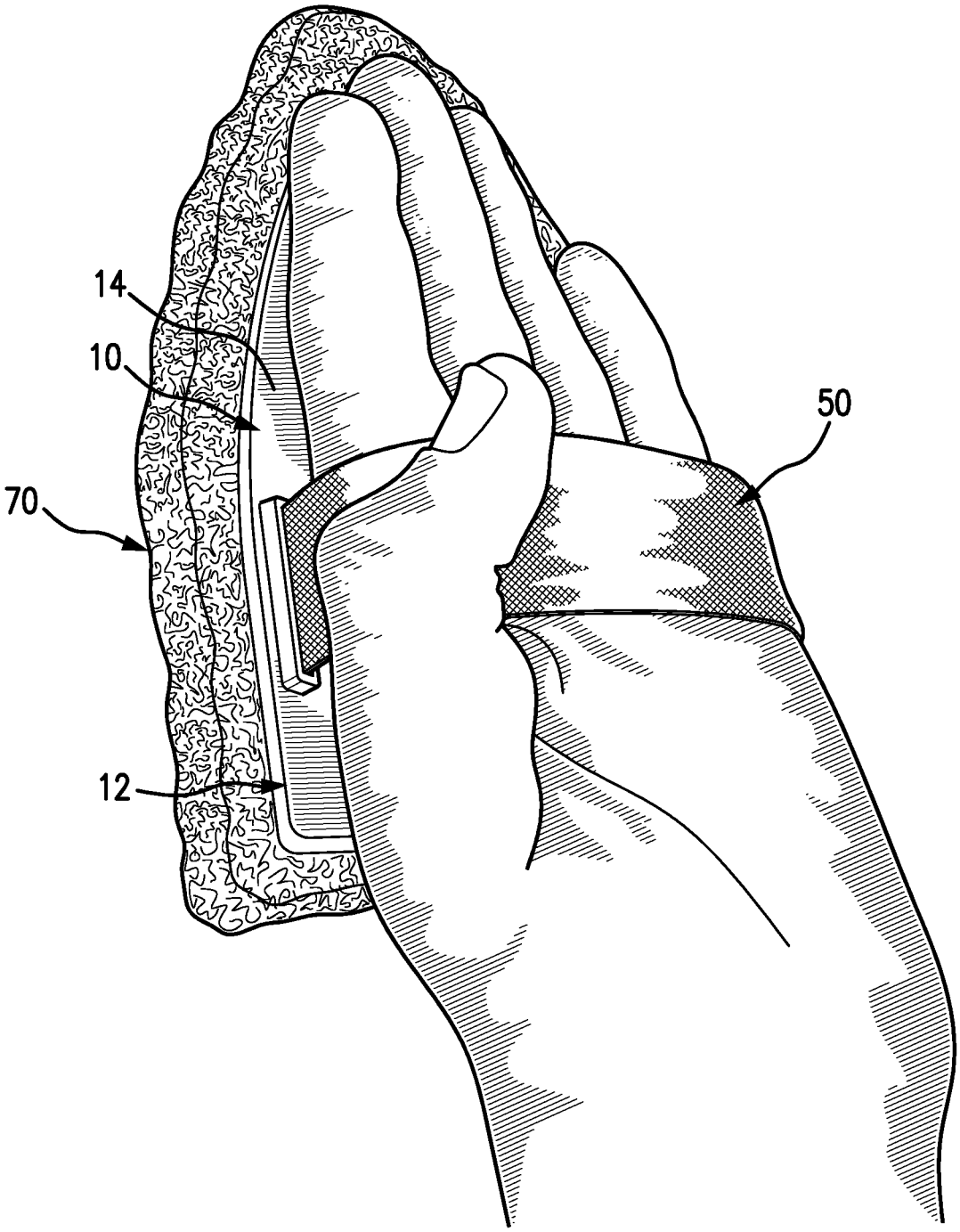
FIG. 5 is a bottom perspective view showing the window cleaning tool secured to the back side of a user's hand for use to clean a window surface.
Figure 6:
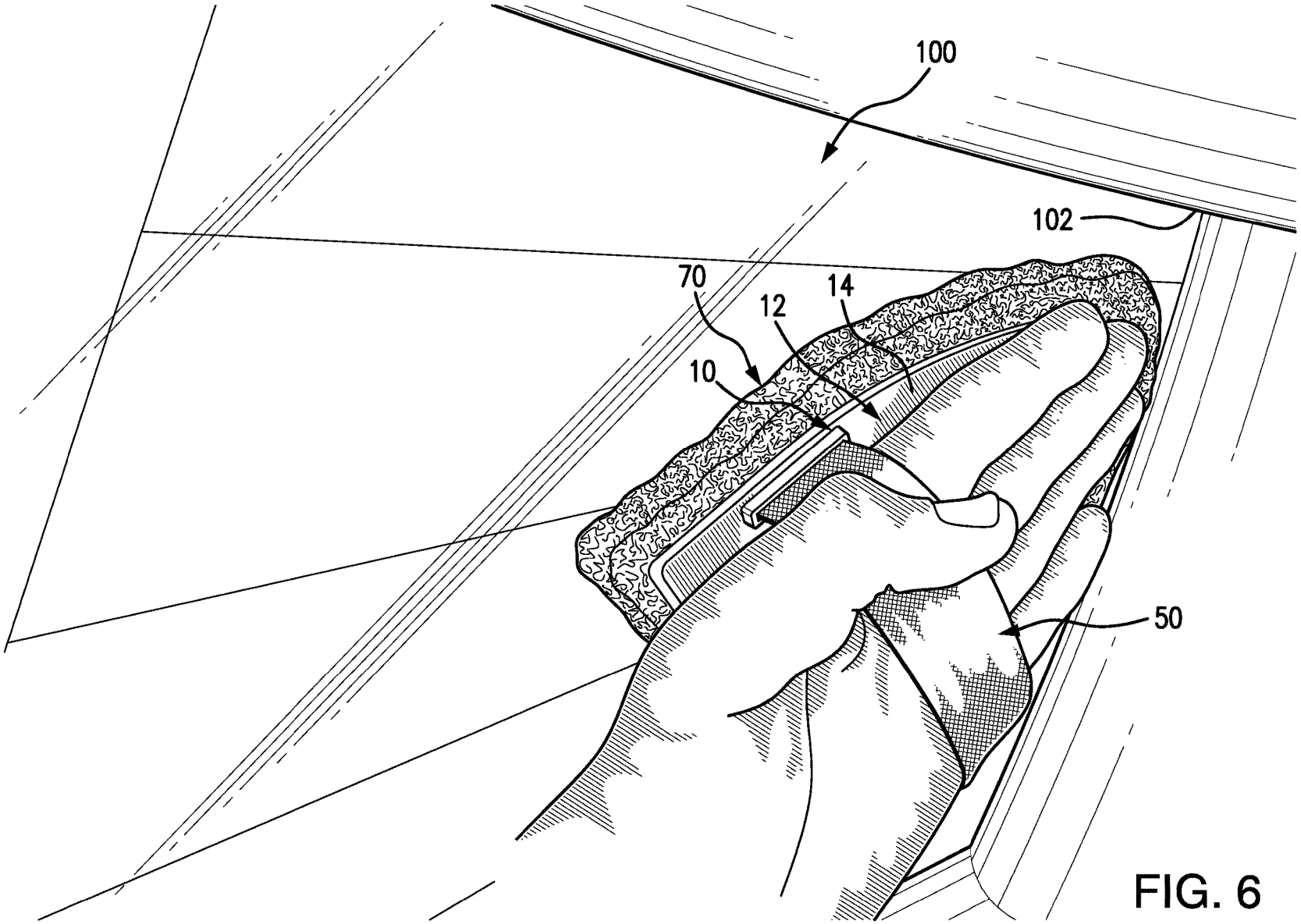
FIG. 6 is a perspective view showing the window cleaning tool secured to a users hand and demonstrating use during the cleaning of an interior surface of a rear window of an automobile.

The flat bottom surface 16 of the plate member 12 is provided with hook material of a hook and loop fastener system for releasably attaching a non-scratch glass cleaning pad 70 thereto, as seen in FIGS. 3-6. In particular, the bottom surface 16 includes a first hook material component 40 of a hook and loop releasable fastener, and a second hook material component 42 of a hook and loop releasable fastener. A strap 50 is fitted to the plate member 12 for securing the plate member to the user's hand, as seen in FIGS. 4-6. More particularly, the strap 50 passes through elongate slot openings 60 formed through the plate member to allow passage of first and second strap segments 52, 54 therethrough. The strap segments 52, 54 overlap, as seen in FIG. 1, to allow the strap to be secured in a closed loop that secures the plate member 12 to the back of a user's hand, as seen in FIGS. 4-6. When properly secured to the user's hand, the nose 30 should extend beyond the fingertips of the user so that the user's fingertips are protected from hitting various structures and objects while cleaning the window surface. Each elongate slot 60 is provided with a raised shoulder 62 extending upwardly from the top surface 14 of the plate member 12 and surrounding the respective elongate slot opening 60. The raised shoulders 62 help to guide the first and second segments 52, 54 of the strap 50 upwardly from the top surface of the plate member 14 while relieving stress on the strap 50, as well as discouraging the tendency of the strap 50 from cutting into the skin of the user's hand.

The non-scratch glass cleaning pad 70 may be formed of a fibrous synthetic material of a type that is available on the market for cleaning various surfaces, such as glass surfaces without scratching the surface. The strap 50 is structured to include a hook component material on an outer facing side and a loop material of a hook and loop fastener on an inner facing side, so that when the strap segments 52, 54 overlap, the hook material on the outer facing surface of one strap segment releasably attaches to the loop component material on the underlying or inner facing surface of the other strap segment thereby allowing the strap segments to be adjustably and releasably secured to properly fit around the user's hand, as seen in FIG. 4. The outer facing side of the strap 50 on the bottom surface of the plate member 16 provides a third hook material component of a hook and loop releasable fastener 56 which, in combination with the first hook material component 40 and the second hook material component 42 allows for secure and releasable attachment of the non-scratch glass cleaning pad 70 to the bottom of the plate member 12. The non-scratch glass cleaning pad 70 is shaped to generally conform with the shape of the plate member, as defined by the peripheral edge, including the back edge 20 and the left and right side edges 22, 24, as well as the nose 30.

In use, the window cleaning tool 10 is secured to the user's hand with the back of the user's hand, particularly the fingers, positioned against the top surface 14 of the plate member, as seen in FIG. 6. The user can then move their hand in a reciprocating cleaning action while directing the nose of the tool and similarly configured cleaning pad 70 into corners 102 of the rear window 100 of an automobile. The entire inside surface of the rear window 100 is cleaned using the window cleaning tool 10 just prior to application of a film substrate, and particularly a window tinting film.

While the present invention has been shown and described in accordance with a preferred and practical embodiment, it is recognized that departures from the instant disclosure are fully contemplated within the spirit and scope of the present invention which is not to be limited, except as defined in the following claims as interpreted under the Doctrine of Equivalents.

What is claimed is:

1. A window cleaning tool comprising:

a rigid plate member having a flat top surface, a flat bottom surface, a peripheral side edge including a back edge and left and right side edges converging towards one another and meeting at a nose of the plate member;

a hand securing strap having an outer facing side and an inner facing side, and the hand securing strap fitted to the plate member for securing the top surface of the plate member against the back of a user's hand, and the hand securing strap including a first strap segment, a second strap segment and a middle section between the first and second strap segments;

the rigid plate member including a first elongate slot opening and a second elongate slot opening spaced from the first elongate slot opening, and the first and second slot openings extending between and openly communicating with the flat top surface and the flat bottom surface of the rigid plate member, and the first and second elongate slot openings being structured and disposed to permit passage of the first and second strap segments therethrough so that the middle section of the hand securing strap extends transversely across the flat bottom surface of the rigid plate member and the first and second strap segments of the hand securing strap extend outwardly from the first and second elongate slot openings and above the flat top surface of the rigid plate member, and the first and second strap segments being structured and disposed for overlapping, releasable attachment to one another to adjustable secure the hand securing strap about the user's hand with the back of the user's hand positioned against the flat top surface of the rigid plate member;

a first releasable attachment component on the flat bottom surface of the rigid plate member between the nose and the middle section of the hand securing strap;

a second releasable attachment component on the flat bottom surface of the rigid plate member between the middle section of the hand securing strap and the back edge of the rigid plate member;

a third releasable attachment component on the outer facing side of the middle section of the hand securing strap, and the third releasable attachment component positioned between the first releasable attachment component and the second releasable attachment component on the flat bottom surface of the rigid plate member; and a non-scratch glass cleaning pad removably attachable to the first releasable attachment component, the second releasable attachment component and the third releasable attachment component on the flat bottom surface of the rigid plate member, and the non-scratch glass cleaning pad is shaped and configured to be congruent with the shape of the plate member as defined by the outer peripheral edge.

2. The window cleaning tool as recited in claim 1 wherein the left and right side edges include left and right rear side edge portions extending in parallel relation to one another and perpendicular to the back edge.

3. The window cleaning tool as recited in claim 2 wherein the left and right side edges include forward conversion portions gradually converging towards one another from the rear side edge portions to the nose.

4. The window cleaning tool as recited in claim 1 wherein each of the first and second elongate slot openings include a raised shoulder surrounding its respective slot opening, the raised shoulders extending upwardly from the top surface of the rigid plate member, the raised shoulders being structured and disposed to guide the first and second strap segments upwardly from the top surface of the rigid plate member and to relieve stress on the strap, while discouraging the strap from cutting into the skin of the user's hand.

* * * * *